US008060989B2

(12) United States Patent
Pierret et al.

(10) Patent No.: US 8,060,989 B2
(45) Date of Patent: Nov. 22, 2011

(54) DEVICE FOR LOADING MACHINES HANDLING MATERIALS IN BULK

(76) Inventors: Philippe Pierret, Corbion (BE); Thierry Pierret, Sainte-Marie/Semois (BE)

( * ) Notice: Subject to any disclaimer, the term of this patent is extended or adjusted under 35 U.S.C. 154(b) by 236 days.

(21) Appl. No.: 12/448,164

(22) PCT Filed: May 22, 2008

(86) PCT No.: PCT/EP2008/056311

§ 371 (c)(1),
(2), (4) Date: Jun. 11, 2009

(87) PCT Pub. No.: WO2008/155189

PCT Pub. Date: Dec. 24, 2008

(65) Prior Publication Data

US 2010/0064483 A1 Mar. 18, 2010

(30) Foreign Application Priority Data

Jun. 21, 2007 (EP) ..... 07110736

(51) Int. Cl.
*D01B 1/00* (2006.01)

(52) U.S. Cl. ..... 19/97.5; 19/105

(58) Field of Classification Search ..... 19/80 R, 19/97.5, 105

See application file for complete search history.

(56) References Cited

U.S. PATENT DOCUMENTS

| | | | | |
|---|---|---|---|---|
| 3,330,319 | A * | 7/1967 | Tschantz | 241/283 |
| 3,923,149 | A * | 12/1975 | Stearns | 198/747 |
| 4,516,734 | A * | 5/1985 | Pierret et al. | 241/283 |
| 5,197,684 | A * | 3/1993 | Bihlet et al. | 241/283 |
| 2002/0039956 | A1 * | 4/2002 | Kitai et al. | 493/424 |

FOREIGN PATENT DOCUMENTS

| | | |
|---|---|---|
| DE | 18 45 781 | 1/1962 |
| DE | 196 18 076 | 7/1997 |
| EP | 0 081 886 | 6/1983 |
| FR | 2 295 142 | 7/1976 |

* cited by examiner

*Primary Examiner* — Shaun R Hurley

(57) ABSTRACT

The invention relates to a device 1 for loading machines handling bulk materials, in particular materials that may be in baled or balled form, such as fibres, yarns, threads or debris from woven or non-woven or plastic textile products. Said device 1 comprises: a hopper 8; a conveying device placed on the base of said hopper 8, to convey a strip of material 3 in a backward conveying direction 4 through an opening 14 and into a machine to be loaded; a knife 15 having a blade 17 that can undergo a reciprocating movement approximately perpendicular to the conveying direction 4 so as to cut the material conveyed into the opening 14; and a device for balancing the reciprocating movement of said blade 17.

26 Claims, 6 Drawing Sheets

DEVICE FOR LOADING MACHINES HANDLING MATERIALS IN BULK

This is a 371 of PCT/EP08/056311 filed May 22, 2008, which has a priority of European no. 07110736.1 filed Jun. 21, 2007, hereby incorporated by reference.

The present invention relates to a device for loading machines handling materials in bulk having a certain length and generally compressed in balls, in particular materials such as fibres, yarns, debris of woven or non-woven textile products or plastics materials.

Originally, machines handling the aforementioned materials were generally fed manually, which presented various drawbacks, namely: the constant presence of personnel at the machines, laborious work, irregular feeding of the said machines due to the difficult handling of the materials processed, and accumulation of fibres escaping from the mass of material around the said machines and constituting a hazard when piles of uncontrolled fibres were snatched by moving components of the machines.

It was attempted first of all to automate the loading of the said machines by means of endless conveyor belts provided with movable projecting elements retracting below the level of the belt when they arrive at the end of the latter. This way of proceeding also had drawbacks, namely the possibility of locking the elements in their cavities by the introduction of material into the latter and the complexity and fragility of the mechanism used for retracting the projecting elements.

To resolve these problems an automatic loading method and device were proposed in European patent application EP-A-0081886, which constitutes the closest prior art. The device described therein comprises:

a) a hopper comprising a set of walls extending between a base and a top, the top of which is open in order to be able to introduce therein a mass of material to be loaded, and which has, in one of the said walls, an opening extending from the base of the said hopper;

b) a driving device arranged in the bottom of the said hopper in order to drive a strip of material towards and through the said opening and towards a machine to be loaded; and c) a knife disposed on a top edge of the opening, comprising a substantially straight blade parallel to the base of the hopper, the said blade being able to move in an alternating movement substantially perpendicular to the direction of driving of the material so as to cut into the material driven towards the opening in order to delimit the top face and adjust the thickness of the said strip of material, the excess material that is cut being directed into the mass of material.

However, this device has certain drawbacks. In particular, this device has an effectiveness limited by the cutting speed.

To resolve this drawback, the device of the present invention also has a device for balancing the alternating movement of the said blade. This has the advantage of allowing a greater speed of the alternating movement of the said blade and therefore a greater cutting speed and efficacy of the loading device.

In a preferred embodiment, the said blade is connected to a control link driven by means of a crankshaft fixed to a rotary shaft in order to provide the said alternating movement of the blade, the said balancing device preferably having a counterweight fixed to the said rotary shaft. This has the advantage of providing the driving and balancing of the blade in its alternating movement in a simple and effective manner.

Even more advantageously, the loading device can also comprise a fixed comb, preferably removable, disposed above the said blade in order to prevent the material from following the movement of the blade. The advantage of this is to increase further the efficacy of cutting and therefore the efficacy of the loading device, while reducing the possibilities of blocking, without for all that preventing the excess material from being directed into the mass of material.

Also more advantageously, the same blade comprises several removable segments, preferably ten in number. This has the advantage of allowing the replacement of a single blade segment in the case of partial damage to this.

Advantageously, the said blade comprises a cutting edge placed below the level of the bottom surface of the said knife, the said bottom surface preferably being substantially smooth. These aspects make it possible to limit the restriction of the strip of material and therefore to increase the efficacy of the loading device.

Advantageously, the said driving device comprises at least two plates arranged at a level lower than that of the said top edge of the opening and provided with a first set of projecting elements, in particular in the form of hooks oriented in the driving direction, at least one of these plates being able to move in an alternating movement substantially parallel to the direction of driving of the material, and at least another one of these plates being either immobile, or able to move in an alternating movement out of phase in relation to that of at least one of these plates, so that the projecting elements of at least one movable plate drive towards the said opening a quantity of material when it moves in this direction and the projecting elements of at least one other plate retain the material so that the latter does not accompany the projecting elements of at least one movable plate when the latter moves in the opposite direction. This embodiment has the advantage of allowing effective driving of the material with simple and reliable means.

Even more advantageously, at least one of the said plates can be fixed removably, preferably bolted. This makes it possible to be able to easily replace this plate with at least one other plate, having for example projecting elements adapted to another material, so as to adapt the machine to other properties of the material that may affect its driving and also to repair the machine easily if one of the plates were to be damaged.

Also more advantageously, the said loading device also comprises programmable control means, particularly for controlling the alternating movement of the at least one movable plate, these programmable means preferably being digital. This embodiment has the advantage of allowing the adaptation of the driving device to different materials with a minimum of physical interventions.

Also more advantageously, the said hopper comprises, on a wall opposite to the said opening, a second set of projecting elements oriented in the driving direction. This second set of projecting elements makes it possible to retain the material so that the latter does not accompany the projecting elements of at least one movable plate when the latter moves in the direction opposite to the driving direction.

Advantageously, the said hopper is also mounted so to pivot on an axis substantially parallel to the base of the hopper and perpendicular to the driving direction, for adjusting the height of a top edge of the said opening. This makes it possible to adjust the height of the said strip of material.

Even more advantageously, the loading device also comprises a skip for supplying the said hopper with material, the said skip being mounted so as to pivot on the same pivot axis of the hopper. This has the advantage of allowing the mechanical loading of the hopper by particularly simple means.

Also more advantageously, the loading device also comprises an outlet channel disposed downstream of the said opening and comprising a roof attached to the hopper with a hinge placed close to the top edge of the opening, so as to be able to be tilted to adjust the height of the outlet channel, the said roof preferably being at least partially removable. As the strip of material may have a tendency to expand upwards behind the opening, which could cause blockage of the strip by rubbing with the said roof, this has the advantage of making it possible to adjust the ideal clamping of the material according to its degree of compressibility.

Advantageously, the said outlet channel comprises, preferably on its roof, a third set of projecting elements, in particular hooks oriented in the driving direction, to prevent the material from moving back.

Advantageously, the said loading device comprises a pressing plate mounted so as to tilt in order to compress the strip of material leaving the loading device, the said pressing plate preferably being provided with a fourth set of projecting elements, in particular hooks oriented in the direction of driving of the strip of material, to prevent the material from moving back. This pressing plate improves the traction of the driving device on the strip of material.

Advantageously, the loading device also comprises a set of lateral projecting elements mounted in the hopper substantially perpendicular to the driving direction to prevent the said excess material from moving back.

The advantage is that this prevents the efficiency of the loading device dropping substantially when little material remains to be loaded into the machine, preventing the excess material sliding far behind in the hopper.

Details concerning the invention are described below in an exemplary and non-limitative manner referring to the drawings.

BRIEF DESCRIPITON OF THE DRAWINGS

DETAILED DESCRIPITION OF THE PREFERRED EMBODIMENTS

Figure 1:
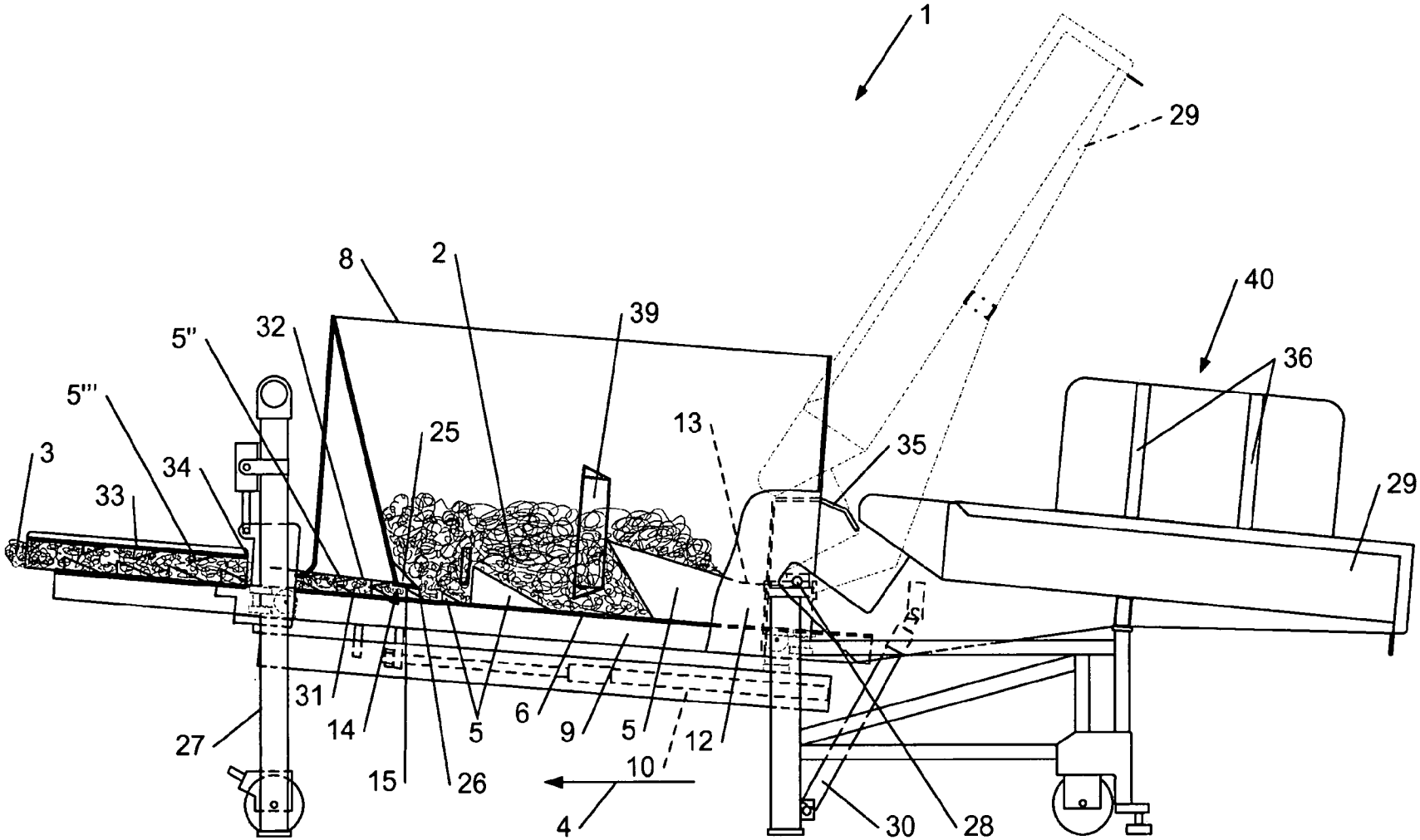
FIG. 1 is a longitudinal section in elevation, with partial breaks, of an example of an inventive device according to the invention associated with a machine to be fed.
Figure 5:
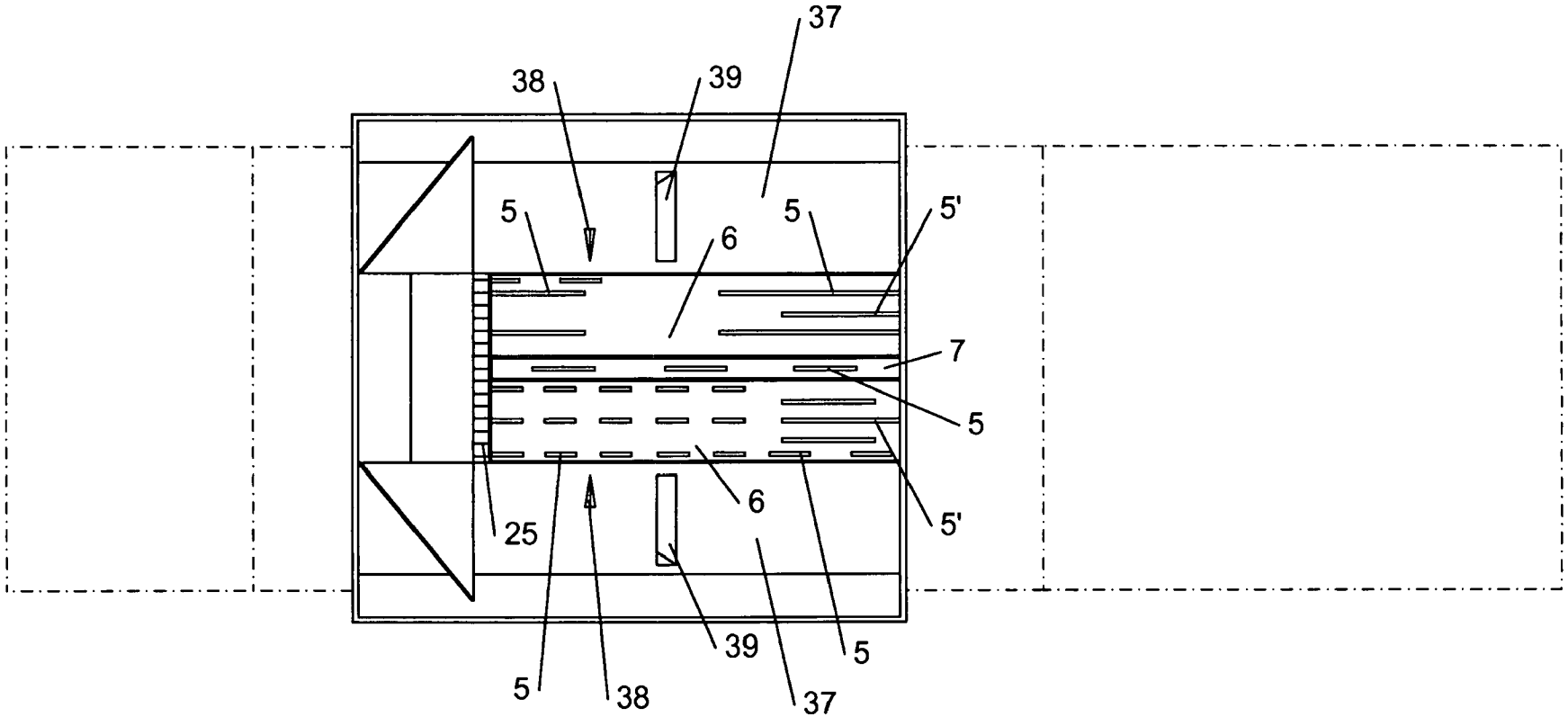
FIG. 5 is a top plan view of the device according to the invention.

An example embodiment of the loading device 1 according to the invention and illustrated in the drawings, in particular FIGS. 1 and 5, is intended for loading a machine, such as a fibre cutter, with fibres, this device being able to continuously extract fibres from a mass of material 2 in order to form a strip 3 with a given cross section corresponding to the cross section of material that can be absorbed by the cutter and to make this strip 3 progress evenly towards the cutter until the time when it is taken up by the conveyor belt of the latter. This extraction of material takes place by virtue of a first set of projecting elements 5 penetrating the mass, at least some of which are movable and which, through their movement, organise the fibres in order to form a strip 3 and to make the latter progress in the driving direction 4.

In the device of this example embodiment, these projecting elements 5 are hooks fixed (preferably removably) to two movable plates 6 and a fixed plate 7 all arranged at the bottom of a hopper 8 able to contain the mass of material 2. The said movable plates 6 are bolted in a removable manner on movable wires 9 able to be driven in a reciprocating alternating movement by hydraulic cylinders 10 able to be controlled in their movement by programmable numeric control means. Preferably, the movement of the two movable bars 9 is out of phase so that, when a first one of the movable bars 9 moves in the direction opposite to the driving direction 4, the other movable bar 9 moves in the driving direction 4, the projecting elements 5 of the at least one movable plate 6 fixed to this other movable bar 9 ensuring, together with those of the fixed plate 7, that the fibres of this strip 3 do not follow the projecting elements 5 of the at least one movable plate 6 fixed to the first movable bar 9 in their withdrawal movement.

Figure 6:
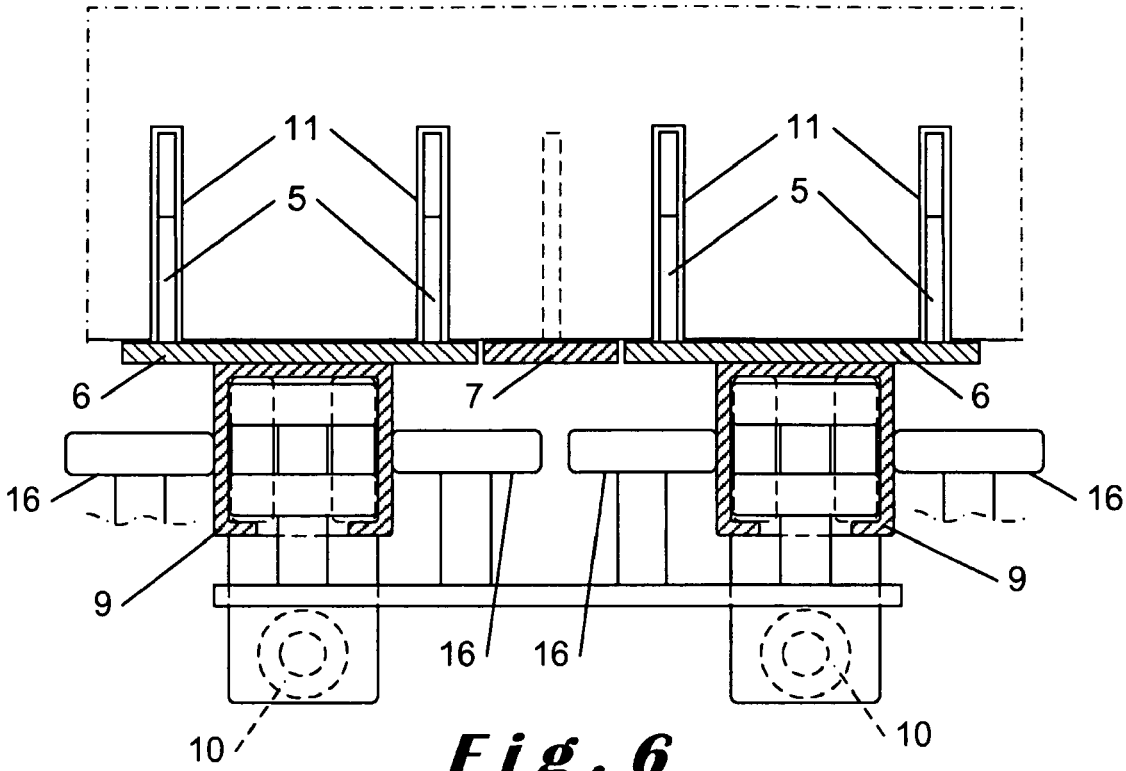
FIG. 6 is a transverse section of the driving device.

As the movable 6 and fixed 7 plates are bolted removably, it is possible to replace them, either to repair them or to adapt the loading device to different materials with different movable 6 and fixed 7 plates, having for example projecting elements 5 with different geometries and/or sizes and/or different in number and/or arrangement. Another advantage is that the movable plate 6 may be wider than the movable bars 9, allowing a lateral spacing of the movable bars 9. By virtue of this lateral spacing, it is possible to support the movable bars 9 with external rollers 16, as illustrated in FIG. 6.

In the loading device of the prior art described in EP-A-0081886, the movable bars were not being spaced apart, and were supported only by internal rollers, which had the drawback that the bars, subjected to torsion forces during the operation of the loading device, ended up by deforming.

The hopper 8 comprises, on the opposite side to the driving direction, slots 11 aligned with projecting elements 5 of the movable plate 6, to allow the said projecting elements 5 to at least partially pass through said slots 11 in their alternating movement. In this way it is possible to place projecting elements 5 very much recessed on the movable plates 6 without their impacting on the rear wall of the hopper 8 in the withdrawal phase of their alternating movement.

The projecting elements 5 intended to pass through the said slots 11 comprise extensions 12, in the opposite direction to the driving direction 4, having a substantially horizontal top edge 13 with a height less than but preferably similar to that of the said slots 11 in order to at least partially occupy the said slots 11 throughout the entire alternating movement of the said movable plate 6, substantially blocking the passage through the said slots 11 to the material to be driven.

The rear wall of the hopper 8 also comprises a second set of projecting elements 5' oriented in the driving direction in order to retain the material so that the latter does not accompany the projecting elements 5 of the movable plates 6 when these move in the opposite direction to the driving direction 4.

By virtue of this driving device, the fibres of the strip 3 can be driven towards an opening 14 extending from the base of the said hopper 8 on the same side as the machine to be loaded. A knife 15 is disposed close to the opening 14 so as to cut in the material driven towards the opening 14 in order to delimit the top face and adjust the thickness of the said strip 3, the excess material that is cut off being directed into the mass of material 2.

Figure 2:
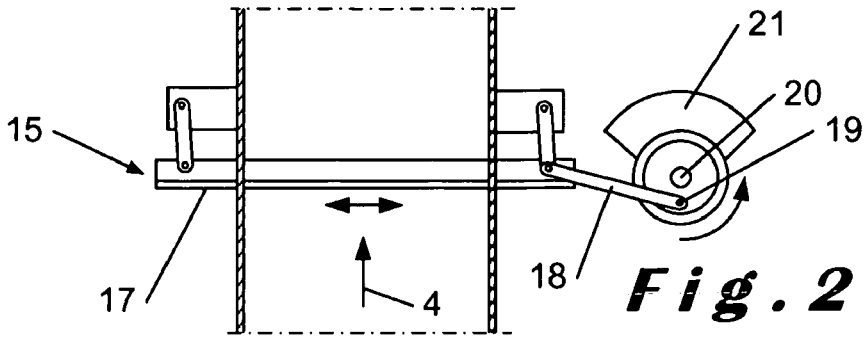
FIG. 2 shows schematically the drive mechanism of the knife.

Turning now to FIG. 2, it can be seen how the said knife 15 has a substantially straight blade 17 parallel to the base of the said hopper 8, the said knife 15 being connected to a control link 18 driven by means of a crankshaft 19 fixed to a rotary shaft 20 in order to provide an alternating movement of the knife 15 and the blade 17 substantially perpendicular to the driving direction of the strip of material 3. A counterweight 21 is fixed to the said rotary shaft 20 in order to balance the blade 17 and knife 15 in their alternating movement. Without the said counterweight 21, the said alternating movement could generate such high-speed vibrations that the loading device could as a result be seriously damaged.

Figure 3:
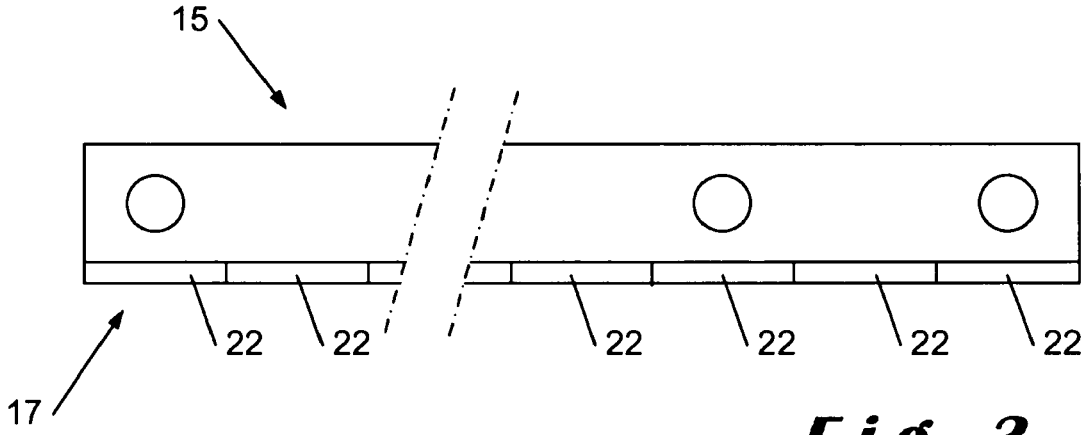
FIG. 3 is a plan view of the knife with the blade.

Turning now to FIG. 3, it can be seen how the said blade 17 comprises ten segments 22 mounted removably on the said knife 15. If one of the segments 22 is damaged, it will therefore not be necessary to change the entire blade 17 in order to repair it, but only the segment 22 in question.

Figure 4:
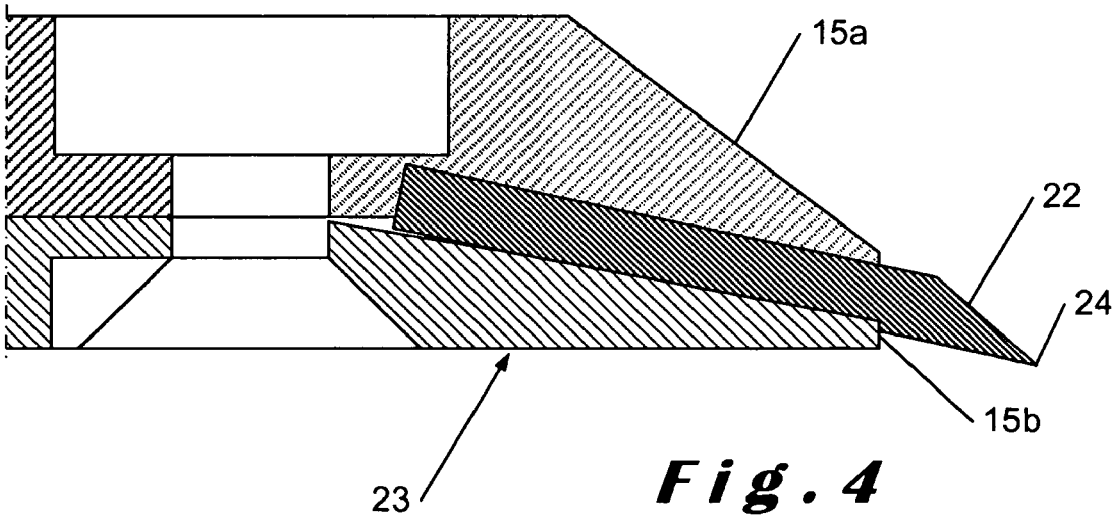
FIG. 4 is a section of the knife with the blade.

Turning now to FIG. 4, it can be seen how the knife 15 has a substantially smooth bottom surface 23, and the cutting edge 24 of the blade 17 is placed below the level of the said bottom surface 23, so as to present a substantially free path for the strip of material behind the said cutting edge 24. The knife 15 has a top part 15*a* and a bottom part 15*b* conformed so as to cooperate in order to hold the segments 22 of the blade 17 when the knife 15 is assembled. In its alternating movement, the knife 15 slides against a linear bearing preferably comprising a set of blocks, for example made from PTFE. A wear detector can be installed in this linear bearing in order to warn the user when it becomes necessary to replace these blocks.

Figure 10:
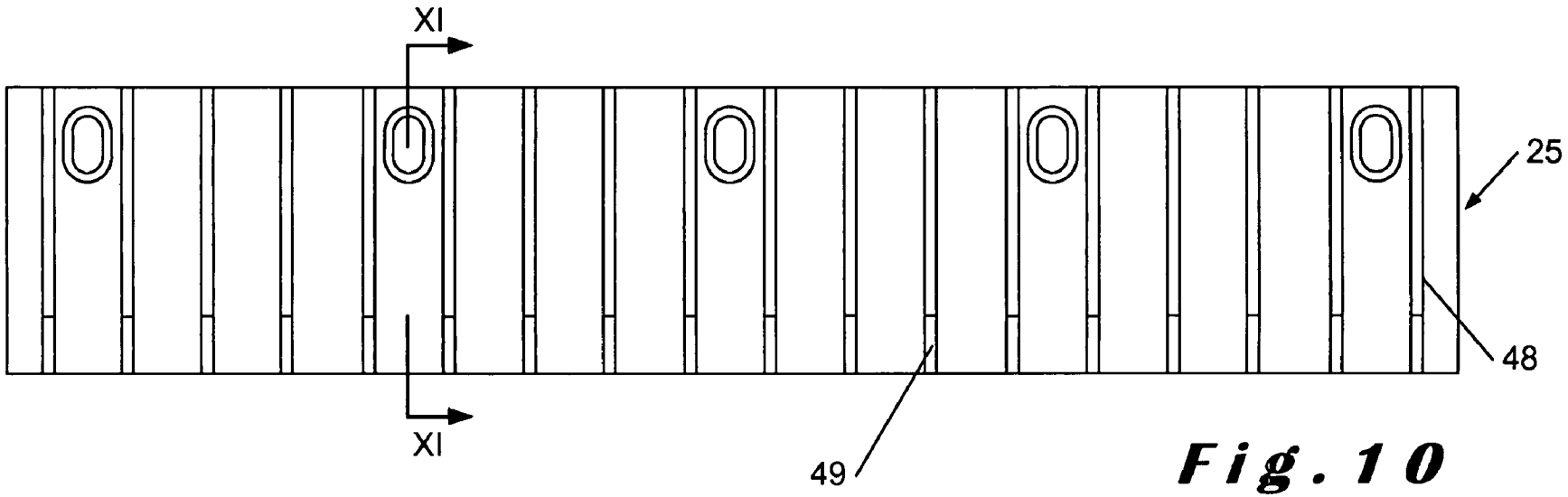
FIGS. 10 and 11 are a plan view and a section of the fixed comb.
Figure 11:
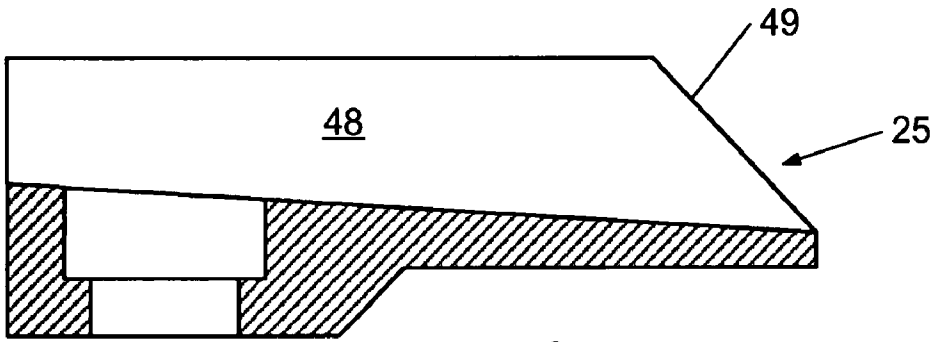

Returning to FIG. 1, a fixed comb 25 can also be seen, disposed removably on the hopper above said blade 17 in order to prevent the material from following the movement of the blade 17. The fixed comb 25, illustrated in more detail in FIGS. 10 and 11, retains the fibres, preventing them from following the transverse reciprocation of the blade 17 and knife 15 and considerably increasing the efficacy of cutting. For this purpose, the fixed comb 25 of the embodiment illustrated comprises a plurality of flat elements 48, oriented in the driving direction 4, spaced apart transversely and having an oblique edge 49, preferably inclined at an angle equal to or close to 45° relative to the driving direction 4. This particular profile prevents the material from following the movement of the blade 17 without for all that preventing the excess material from being directed into the mass of material 2. The fixed comb 25 above the blade 17 can be complemented by a deflector below on each side of the hopper 8. The purpose of this deflector is to prevent the material from emerging laterally into the cutting system.

In order to be able to adjust the height of a top edge 26 of the opening 14, the hopper 8 is mounted so as to tilt on a fixed frame 27 with a tilting axis 28 substantially parallel to the base of the hopper 8 and placed on the opposite side to the said opening 14. To facilitate the loading of the said hopper 8 with a mass of material 2, the loading device 1 also comprises a skip 29 mounted so as to tilt with the same tilting axis 28 as the hopper, the common tilting axis 28 simplifying the loading device 1. In particular, the junction between the hopper 8 and the skip 29 can in this way be provided by a plate 35 with simple curvature on the hopper 8. The skip 29 in this example is actuated by a single hydraulic cylinder 30.

Figure 7:
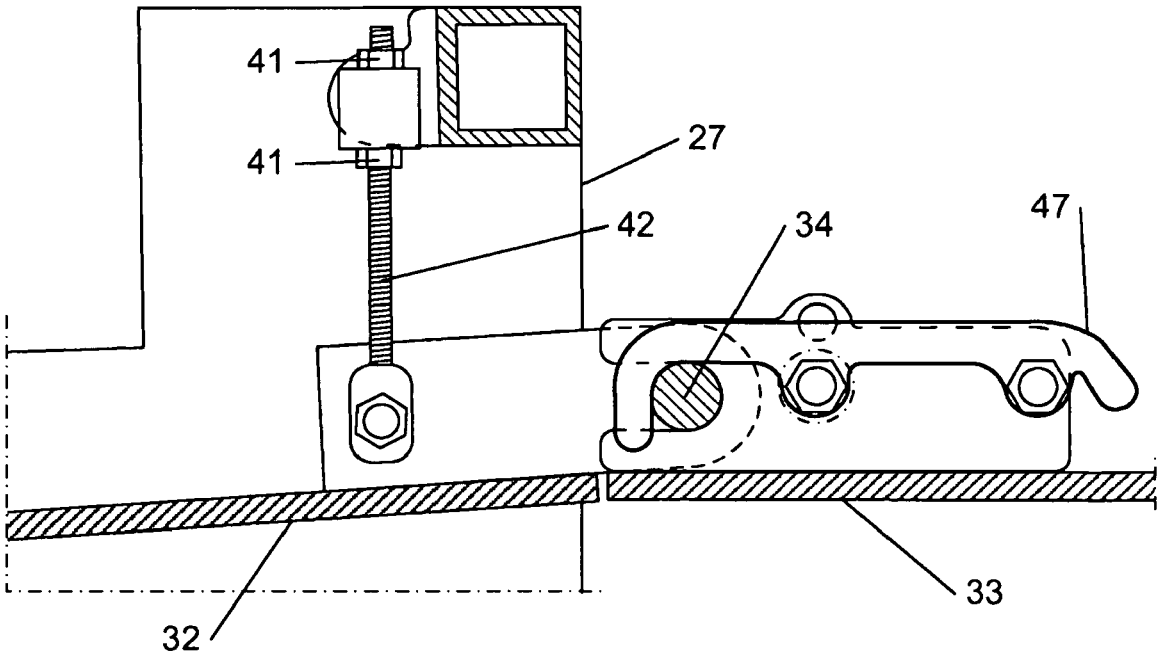
FIG. 7 is a detailed view of the device for adjusting the height of the outlet channel and of the hinge device of the pressing plate.

Behind the opening 14 an outlet channel 31 extends comprising a roof 32 mounted so as to tilt on a hinge fixed close to the top edge 26 of the opening 14, and fixed so as to be able to be removed easily. The outlet channel 31 also comprises a third set of projecting elements 5" in the form of hooks, in particular on the said roof 32, to prevent the return of material at this level. The independent adjustment of the roof 32 by tilting, and the possibility of removing it in order to replace it with a roof 32 having projecting elements 5" of different forms and dimensions, also make it possible to adapt the outlet channel 31 to different materials to be driven. In FIG. 7, it can be seen how the tilting angle of the roof 32 can be adjusted with nuts 41 fixed to threaded elements 42.

Figure 8:
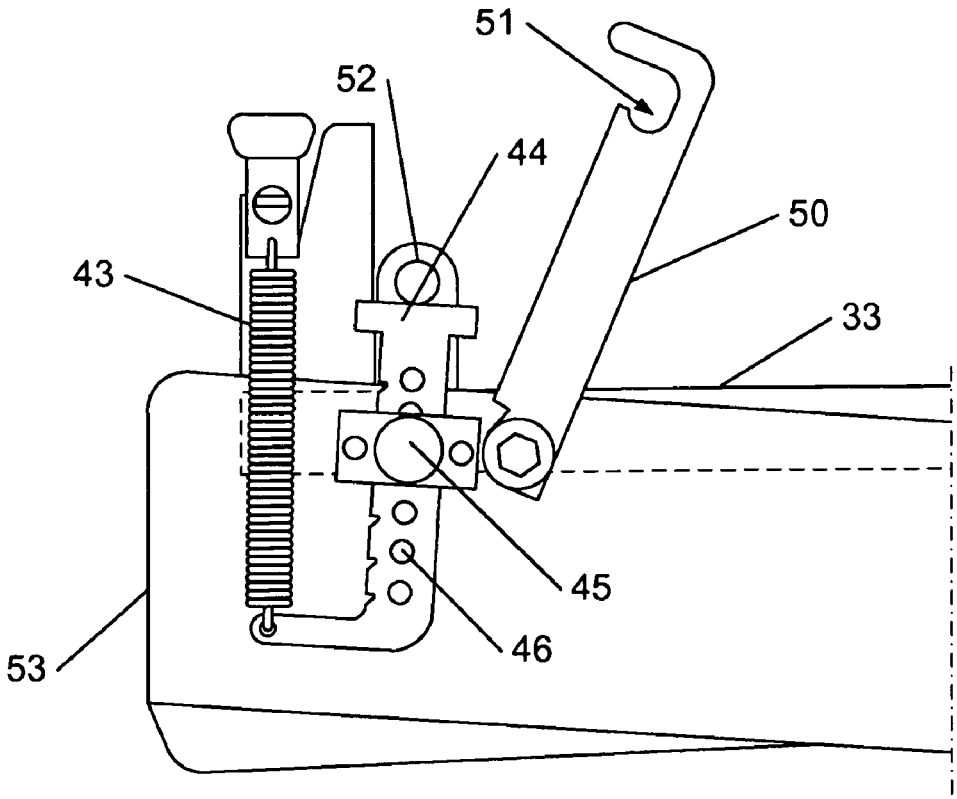
FIG. 8 is a detailed view of the device adjusting the pressing plate.
Figure 9:
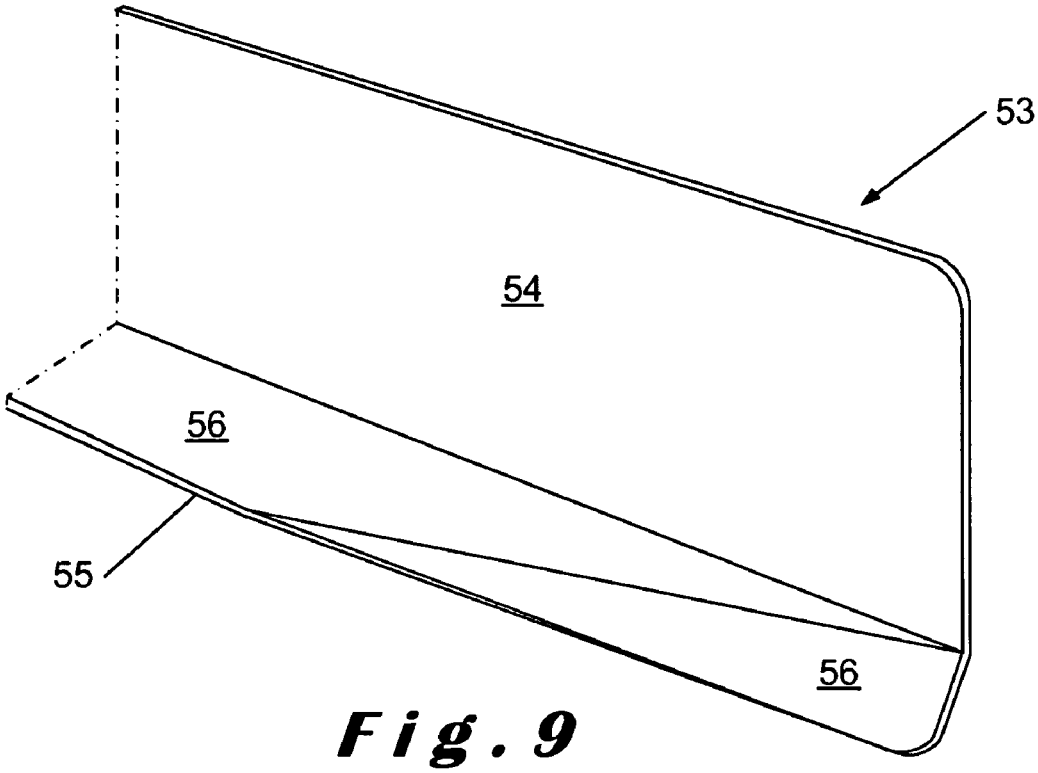
FIG. 9 is perspective view of a lateral element for providing the join with a machine to be loaded.

A pressing plate 33 is disposed in its turn in line with the roof 32 of the outlet channel 31. As can be seen in FIG. 7, the said pressing plate 33 is mounted pivotally on a spindle 34 integral with the roof 32, held by trunnions 47. Turning now to FIG. 8, it can be seen how springs 43 draw the pressing plate 33 downwards so as to compress the strip 3 at the discharge from the outlet channel 31. The positions of the springs 43 and buffers 44 limiting the tilting of the pressing plate 33 are adjustable by means of pins 45 that can be introduced into positioning holes 46 so as to adapt the pressing plate 33 to different materials that can be used in the loading device. The device also comprises a support lever 50 that can tilt forwards in order to support the pressing plate 33 in a raised position during the positioning of the pins 45 in the holes 46. The support lever 50 comprises a notch 51 able to receive a bar 52 attached to the pressing plate 33. Ideally, the said pressing plate 33 is also provided with a fourth set of projecting elements 5'" in order to prevent the return of material and removable, for example by opening the trunnions 46, which facilitates the cleaning and adaptability of the loading device, the pressing plate 33 being able to be replaced by another pressing plate 33 with projecting elements 5'" adapted to a different material.

To provide the junction with the machine to be loaded downstream, this embodiment of the loading device 1 is also provided at its outlet with two lateral elements 53 in the form of plates and each having a surface for lateral holding 54 of the strip of material 3 and a part 55 supporting the strip 3 placed alongside the movable plates 6. In the loading device 1 illustrated, each support part 55 opens towards the driving direction 4, forming two support surfaces 56, one of which is substantially perpendicular to the lateral holding surface 54 and the other slightly oblique.

Turning now to FIG. 5, it can be seen how the hopper 8 comprises two lateral walls 37 substantially parallel to the driving direction 4 and on which there are fixed a lateral hook 38 oriented downwards and a lateral bar 39 with a substantially triangular cross section, both the lateral hook 38 and the main axis of the lateral bar 39 being orientated in a plane substantially perpendicular to the driving direction 4. As the hook 38 and bar 39 project in the hopper 8 substantially perpendicular to the driving direction 4, they help to prevent the excess mass sliding towards the rear of the hopper 8 along the lateral walls 37.

In operation, the skip 29 is first of all loaded with a mass of material 2 forming a ball 40. The bands 36 retaining the ball 40 are cut manually. Next the skip 29 is tilted by the hydraulic cylinder 30 in order to introduce the mass of material 2 into the hopper 8 through its top. In the bottom of the hopper 8 the movable plates 6, actuated by the hydraulic cylinders 10 controlled by programmable control means, perform their reciprocating movement driving with their projecting elements 5 a strip of material 3 towards the knife 15 and the opening 14. The knife 15, driven by the rotary shaft 20, the crankshaft 19 and the control link 18 in a reciprocating movement substantially perpendicular to the driving direction 4 of the strip 3, cuts with the blade 17 into the material in order to delimit the top face and adjust the thickness of the said strip of material 3, the excess material that is cut being directed into the mass of material 2 by the hooks and lateral bars 38, 39 disposed in the hopper 8. The strip 3 is then driven through the opening 14, the outlet channel 31 and under the pressing plate 33 in order to arrive in the machine to be loaded.

As all the actuators of the loading device 1 of this example embodiment are hydraulic, it is particularly advantageous to combine all the elements controlling these actuators in a single control console coupled separably to the hydraulic supply pipes of these actuators. This would have the advantage of affording greater flexibility in use of a set of such loading devices 1 and facilitating the maintenance of each loading device 1. The same type of modular arrangement of the control means would also be advantageous for loading devices 1 using other types of fluid actuators, such as pneumatic actuators, even electrical actuators, for actuating the hopper 8, the skip 29 and/or the movable bars 9.

Although the various improvements proposed in this example embodiment of the loading device of the invention vis-à-vis that described in EP-A-0081886 are particularly advantageous in combination, it is obvious that each of them could be adapted independently to the device of the prior art in order to obtain the advantages directly related to each of them.

Although the present invention has been described with reference to specific example embodiments, it is obvious that different modifications and changes can be made to these examples without departing from the general scope of the invention as defined by the claims. Consequently the description and drawings must be considered in an illustrative rather than restrictive sense.

REFERENCES IN THE FIGURES

1 Loading device
2 Mass of material
3 Strip of material
4 Driving direction
5 Projecting elements in the first set
5' Projecting elements in the second set
5" Projecting elements in the third set
5'" Projecting elements in the fourth set
6 Movable plates
7 Fixed plate
8 Hopper
9 Movable bars
10 Hydraulic cylinders
11 Slots
12 Extension
13 Top edge
14 Opening
15 Knife
15*a* Top part
15*b* Bottom part
16 External rollers
17 Blade
18 Control link
19 Crankshaft
20 Rotary shaft
21 Counterweight
22 Blade segments
23 Bottom surface of knife
24 Blade cutting edge
25 Fixed comb
26 Top edge
27 Fixed frame
28 Tilting axis
29 Skip
30 Hydraulic cylinder
31 Outlet channel
32 Roof
33 Pressing plate
34 Pivot axis
35 Junction plate
36 Retaining bands
37 Lateral walls
38 Lateral hooks
39 Lateral bars
40 Ball
41 Nut
42 Threaded element
43 Spring
44 Buffer
45 Pin
46 Positioning hole
47 Retaining trunion
48 Flat element
49 Oblique edge
50 Support lever
51 Notch
52 Bar
53 Lateral element
54 Lateral holding surface
55 Support part
56 Support surface

The invention claimed is:

1. Loading device (1) for loading machines processing materials in bulk, the device comprising:

a) a hopper (8) comprising a set of walls extending between a base and a top, the top of which is open in order to be able to introduce therein a mass of material (2) to be loaded, and which also has, in a wall, an opening (14) extending from the base of the hopper (8);

b) a driving device arranged in the base of the hopper (8) in order to drive a strip (3) of material in a driving direction towards and through the opening (14) and towards a machine to be loaded;

c) a knife (15) disposed on a top edge (26) of the opening (14), comprising a substantially straight blade (17) parallel to the base of the hopper (8), the blade (17) being able to move in an alternating movement substantially perpendicular to the direction (4) of driving of the strip of material (3) so as to cut into the material driven towards the opening (14) in order to delimit the top face and adjust the thickness of the strip of material (3), the excess material that is cut being directed into the mass of material (2);

the loading device (1) further comprising a device for balancing the alternating movement of the blade (17) and an outlet channel (31) disposed downstream of the opening (14) and comprising a roof (32) attached to the hopper (8) with a hinge placed close to the top edge (26) of the opening (14), so as to be able to be tilted in order to adjust the height of the outlet channel (31).

2. Loading device (1) according to claim 1, characterized in that the knife (15) is connected to a control link (18) driven by means of a crankshaft (19) fixed to a rotary shaft (20) in order to provide the alternating movement of the blade, the balancing device comprising a counterweight (21) fixed to the rotary shaft (20).

3. Loading device (1) according to claim 1, further comprising a fixed comb (25) disposed above the blade (17) in order to prevent the material from following the movement of the blade (17).

4. Loading device (1) according to claim 1, characterized in that the blade (17) has a cutting edge (24) placed below the level of the bottom surface (23) of the knife (15), the bottom surface (23) being substantially smooth.

5. Loading device (1) according to claim 1, characterized in that the blade (17) comprises several removable segments (22).

6. Loading device (1) according to claim 1, characterised in that the driving device comprises at least two plates (6, 7) arranged at a level lower than that of the top edge (26) of the opening (14) and provided with a first set ofprojecting elements (5) oriented in the driving direction, at least a first one of these plates (6) being able to move in an alternating movement substantially parallel to the direction (4) of driving of the strip of material (3), and at least another one of the plates (6, 7) being either immobile, or able to move in an alternating movement out of phase in relation to that of at least one of these plates (6, 7), so that the projecting elements (5) of at least one movable plate (6) drive towards the opening (14) a quantity of material when the quantity of material moves in this direction and the projecting elements (5) of at least one other plate (6, 7) retain the material so that the latter does not accompany the projecting elements (5) of at least one movable plate (6) when the latter moves in the opposite direction.

7. Loading device (1) according to claim 6, characterized in that at least one of the plates (6, 7) is mounted removably.

8. Loading device (1) according to claim 6, characterized in that at least one movable plate (6) is fixed to a movable bar (9) and is hydraulically driven and/or supported by holding rollers, at least part of which is situated outside it.

9. Loading device (1) according to claim 6, further comprising programmable control means for controlling the alternating movement of at least one movable plate (6).

10. Loading device (1) according to claim 6, characterized in that the hopper (8) comprises, in a wall opposite to that of the opening (14), at least one slot (11) aligned with a projecting element (5) of the at least one movable plate (6), to enable the projecting element to at least partially pass through the slot (11) in its alternating movement, and in that the projecting element (5) comprises an extension (12) in the opposite direction to that of the driving direction and having a substantially horizontal top edge (13) with a height less than but similar to that of the slot (11) in order to at least partially occupy the slot (11) during the entire alternating movement of the movable plate (6), substantially blocking the passage through the slot (11) to the material to be driven.

11. Loading device (1) according to claim 6, characterized in that the hopper (8) has, on a wall opposite to the opening (14), a second set of elements (5') projecting in the driving direction.

12. Loading device (1) according to claim 1, characterized in that the hopper (8) is also mounted so as to tilt on a fixed frame (27) with a tilt axis (28) substantially parallel to the base of the hopper (8) and perpendicular to the driving direction (4), for adjusting the height of the top edge (26) of the opening (14).

13. Loading device (1) according to the claim 10, further comprising a skip (29) for facilitating the loading of the hopper (8) with material, the skip (29) being mounted so as to tilt with the same tilt axis (28) as the hopper (8).

14. Loading device (1) according to claim 1, characterized in that the outlet channel (31) comprises a third set of projecting elements (5") on its roof (32) oriented in the driving direction (4), for preventing the material from moving back.

15. Loading device (1) according to claim 1, further comprises a pressing plate (33) mounted so as to tilt for compressing the strip of material (3) emerging from the loading device, the pressing plate (33) being provided with a fourth set of projecting elements (5''') oriented in the driving direction (4), for preventing the material from moving back.

16. Loading device (1) according to claim 15, characterized in that it comprises, on each side of the pressing plate (33), a lateral element (53) for providing the junction with a loading machine downstream, each of the lateral elements (53).

17. Loading device (1) according to claim 1, further comprising a set of lateral projecting elements (38, 39) mounted in the hopper (8) substantially perpendicular to the driving direction (4) in order to prevent the excess material from moving back.

18. Loading device (1) according to claim 17, characterized in that the set of walls of the hopper comprises two lateral walls (37) substantially parallel to the driving direction (4), and in that, on each of the two lateral walls (37), there is mounted at least one of the lateral projecting elements (38, 39).

19. Loading device (1) according to claim 17, characterized in that at least one of the lateral projecting elements (38, 39) is a hook (38) oriented at least partially downwards in a plane substantially perpendicular to the driving direction (4).

20. Loading device (1) according to claim 17, characterized in that at least one of the lateral projecting elements (38, 39) is a bar (39) having a substantially triangular cross section and a principal axis substantially perpendicular to the driving direction (4).

21. Loading device according to claim 1, characterized in that the roof is at least partially removable.

22. Loading device according to claim 3, characterized in that the fixed comb (25) is removable.

23. Loading device according to claim 9, characterized in that the programmable means is numeric.

24. Loading device according to claim 16, characterized in that each of the lateral elements (53) comprises a surface (54) for lateral holding of the strip of material (3) and/or a part (55) for supporting the strip (3) substantially level with the movable plates (6).

25. Loading device (1) for loading machines processing materials in bulk, the device comprising:

a) a hopper (8) comprising a set of walls extending between a base and a top, the top of which is open in order to be able to introduce therein a mass of material (2) to be loaded, and which also has, in a wall, an opening (14) extending from the base of the hopper (8);

b) a driving device arranged in the base of the hopper in oder to drive a strip (3) of material in a driving direction towards and through the opening (14) and towards a machine to be loaded, the driving device comprising at least two plates (6, 7) arranged at a level lower than that of the top edge (26) of the opening (14) and provided with a first set of projecting elements (5) oriented in the driving direction, at least a first one of these plates (6) being able to move in an alternating movement substantially parallel to the direction (4) of driving of the strip of material (3), and at least another one of these plates (6, 7) being either immobile, or able to move in an alternating movement out of phase in relation to that of at least one of these plates (6, 7), so that the projecting elements (5) of at least one movable plate (6) drive towards the opening (14) a quantity of material when the quantity of material moves in this direction and the projecting elements (5) of at least one other plate (6, 7) retain the material so that the latter does not accompany the projecting elements (5) of at least one movable plate (6) when the latter moves in the opposite direction;

c) a knife (15) disposed on a top edge (26) of the opening (14), comprising a substantially straight blade (17) parallel to the base of the hopper (8), the blade (17) being able to move in an alternating movement substantially perpendicular to the direction (4) of driving of the strip of material (3) so as to cut into the material driven towards the opening (14) in order to delimit the top face and adjust the thickness of the strip of material (3), the excess material that is cut being directed into the mass of material (2);

the loading device (1) further comprising a device for balancing the alternating movement of the blade (17) and an outlet channel (31) disposed downstream of the opening (14) and comprising a roof (32) attached to the hopper (8) with a hinge placed close to the top edge (26) of the opening (14), so as to be able to be tilted in order to adjust the height of the outlet channel (31).

26. Loading device (1) according to claim 25, characterized in that the hopper (8) has, on a wall opposite to the opening (14), a second set of elements (5') projecting in the driving direction.

* * * * *